US009612022B2

(12) United States Patent
Chiang

(10) Patent No.: US 9,612,022 B2
(45) Date of Patent: Apr. 4, 2017

(54) TEPPANYAKI ASSEMBLY

(75) Inventor: Ting-Fang Chiang, Kaohsiung (TW)

(73) Assignee: Fancy Food Service Equipment Co., Ltd., Kaohsiung (TW)

( * ) Notice: Subject to any disclaimer, the term of this patent is extended or adjusted under 35 U.S.C. 154(b) by 0 days.

(21) Appl. No.: 13/074,840

(22) Filed: Mar. 29, 2011

(65) Prior Publication Data

US 2012/0247345 A1 Oct. 4, 2012

(51) Int. Cl.
*G07F 9/10* (2006.01)
*F24C 15/20* (2006.01)

(52) U.S. Cl.
CPC ..... *F24C 15/2035* (2013.01); *F24C 15/2042* (2013.01); *F24C 15/2057* (2013.01)

(58) Field of Classification Search
CPC ..... F24C 15/2035; F24C 15/2042; F24C 15/2057
USPC ..... 99/357, 339, 340, 422; 165/41, 42, 43, 165/46, 54, 76, 104.11, 104.19, 104.21, 165/104.33, 140, 200, 201, 202, 205, 212, 165/217, 222, 234, 235, 238, 248, 249
See application file for complete search history.

(56) References Cited

U.S. PATENT DOCUMENTS

| | | | | |
|---|---|---|---|---|
| 2,974,663 | A | 3/1961 | Humbert | |
| 3,102,533 | A | 9/1963 | Jenn et al. | |
| 3,260,189 | A | 7/1966 | Jensen | |
| 3,491,744 | A | 1/1970 | Von Kohorn et al. | |
| 3,665,914 | A * | 5/1972 | Berger | 126/41 R |
| 3,891,548 | A * | 6/1975 | Marcussen | 210/791 |
| 4,821,704 | A | 4/1989 | Tucker et al. | |
| 4,846,146 | A | 7/1989 | Tucker et al. | |
| 5,042,456 | A | 8/1991 | Cote | |
| 5,168,796 | A | 12/1992 | Porton et al. | |
| 5,211,159 | A | 5/1993 | Lieblein et al. | |
| 5,287,799 | A | 2/1994 | Pickering et al. | |
| 6,189,530 | B1 | 2/2001 | Shingler | |
| 6,297,482 | B1 | 10/2001 | Becker | |
| 6,488,022 | B2 | 12/2002 | Shingler | |
| 6,575,157 | B1 | 6/2003 | Shaver | |
| 6,716,274 | B2 * | 4/2004 | Gogins et al. | 95/273 |
| 6,739,330 | B1 | 5/2004 | Ross | |
| 6,837,152 | B1 * | 1/2005 | Chiang | A47J 36/38 126/299 E |
| 7,132,009 | B2 | 11/2006 | Chiang | |

(Continued)

FOREIGN PATENT DOCUMENTS

| | | | |
|---|---|---|---|
| CN | 203506449 U | | 4/2014 |
| WO | WO2009015919 | * | 2/2009 |

*Primary Examiner* — Quang D Thanh
*Assistant Examiner* — Joseph Iskra
(74) *Attorney, Agent, or Firm* — Rosenberg, Klein & Lee

(57) ABSTRACT

A teppanyaki assembly includes a platform including a cooking plane, an air pump installed in the platform, and an air filter connected to the air pump. The air filter has a housing with an air room defined therein connecting to an air channel of the air pump and a filter screen slantwise disposed within the air room for increasing an area available for filtering air and oil fumes, thereby facilitating an increase in transient air flow, a decrease in wind resistance, and an efficient oil fumes interception to prevent the problem of air pollution. An additional arrangement of a cleaning door on the housing also allows the filter screen to be promptly taken out for following washing and maintaining proceedings, which increases the using convenience.

6 Claims, 7 Drawing Sheets

(56) References Cited

U.S. PATENT DOCUMENTS

| | | | |
|---|---|---|---|
| 7,825,353 | B2 | 11/2010 | Shingler |
| D636,630 | S | 4/2011 | Shingler |
| 7,926,417 | B2 | 4/2011 | Shingler |
| 8,020,546 | B1 | 9/2011 | Bourgeois et al. |
| 8,312,873 | B2 | 11/2012 | Gagas et al. |
| 8,530,795 | B2 | 9/2013 | Shingler |
| 8,872,077 | B2 | 10/2014 | Gagas et al. |
| 9,125,244 | B2 | 9/2015 | Oagley et al. |
| 9,220,368 | B2 | 12/2015 | Shingler |
| 2006/0201496 | A1 | 9/2006 | Shingler |
| 2007/0062513 | A1 | 3/2007 | Gagas |
| 2010/0024655 | A1 | 2/2010 | Lehman et al. |
| 2012/0174801 | A1 | 7/2012 | Chiang |
| 2013/0042853 | A1 | 2/2013 | Chiang |
| 2015/0144616 | A1 | 5/2015 | Gagas et al. |

* cited by examiner

TEPPANYAKI ASSEMBLY

BACKGROUND OF THE INVENTION

1. Field of the Invention

The present invention relates to a teppanyaki assembly, particularly to one able to decrease a wind resistance and efficiently increase an interception to which oil fumes are subjected.

2. Description of the Related Art

A typical teppanyaki assembly 1 includes a platform 11 having a cooking plane 111 disposed thereon, an air pump 12 having an air channel 121 defined on a side of the cooking plane 111 and a covering 122 disposed on the air channel 121, a filter screen 13 disposed inside the air pump 12, and an electrostatic apparatus 14 disposed in the platform 11. Further, the air pump 12 also has a receiving hole 123 defined on the air channel 121 for taking the filter screen 13 out. When the cooking plane 111 generates oil fumes and smelly air while cooking, the oil fumes pass through the covering 122 and the air channel 121. The oil fumes are thence filtered by the filter screen 13 and removed by the electrostatic apparatus 14. Generally, the filter screen 13 needs to be often cleaned up for keeping the air circulation. Whereas, due to the fact that the filter screen 13 occupies part of the air channel 121, the space of the air channel 121 is relatively reduced while filtering the oil fumes, which however causes a large wind resistance and influences the discharge of the air by a low flow of wind, hence decreasing the efficiency of extracting oil fumes and even incurring the air pollution. The tradition way to solve these problems is to higher the air pressure and the mechanism power, but such a way leads to a consumption of energy and noisiness. Further regard to the problem that the inner wall of the air channel 121 may be covered with grime from the oil while passing the oil fumes therethrough, the solution is to simply take out and rinse the filter screen 13. There may still be a layer of oil grime difficult to remove stunk on the invisible places within the air channel 121 and the receiving hole 123 when in a long term of using, which is probably detrimental to the sanitary problem and becomes an oxidizer of a fire accident.

SUMMARY OF THE INVENTION

An object of the present invention is to provide a teppanyaki assembly which decreases a wind resistance and efficiently promotes to filter oil fumes, so as to increase the efficiency of extracting the oil fumes.

A further object of the present invention is to provide a teppanyaki assembly able to increase a cleaning efficiency and a using convenience.

The teppanyaki assembly in accordance with the present invention comprises a platform having a cooking plane disposed thereon, an air pump having an air channel defined on a side of the cooking plane and a covering disposed on the air channel, and an air filter connecting to the air pump. Particularly, the air channel has a housing with an air room communicated with the air channel of the air pump and a filter screen slantwise disposed within the air room. By the housing structure and the disposition of the inclined filter screen, the teppanyaki assembly is able to expand the filtering area thereof and increase the quantity of transient air flow, thereby efficiently decreasing the wind resistance and allowing capturing the oil fumes from the cooking plane for preventing the air pollution. Preferably, an addition of a cleaning door can be attained to allow the filter screen to be promptly taken out for conducing to a washing and a maintaining proceedings, thus increasing the using convenience.

Preferably, a filter device for re-filtering communicates with a wind outlet disposed on the housing.

Preferably, a cleaning channel is disposed by the side of the air channel for fluid to flow therealong and is communicated with a filtered area of the air room, and a water outlet is disposed on the housing for discharging the fluid therefrom.

Preferably, a guiding channel is formed between the air channel and the filter screen and is communicated with the cleaning channel, beneficial of cleaning.

Preferably, a water inlet is formed on the air channel for an entrance of the fluid.

Preferably, a cleaning door is disposed on the housing for easily taking out the filter screen.

Preferably, a drawing opening is disposed on the housing for easily taking out the filter screen.

Preferably, a guiding board is disposed in the air room relative to a wall of the housing to promote the air circulation and keep a preferable extracting effect.

The advantages of the present invention over the known prior arts will become apparent to those skilled in the art upon reading following descriptions in junction with the accompanying drawings.

DETAILED DESCRIPTION OF THE PREFERRED EMBODIMENTS

Figure 1:
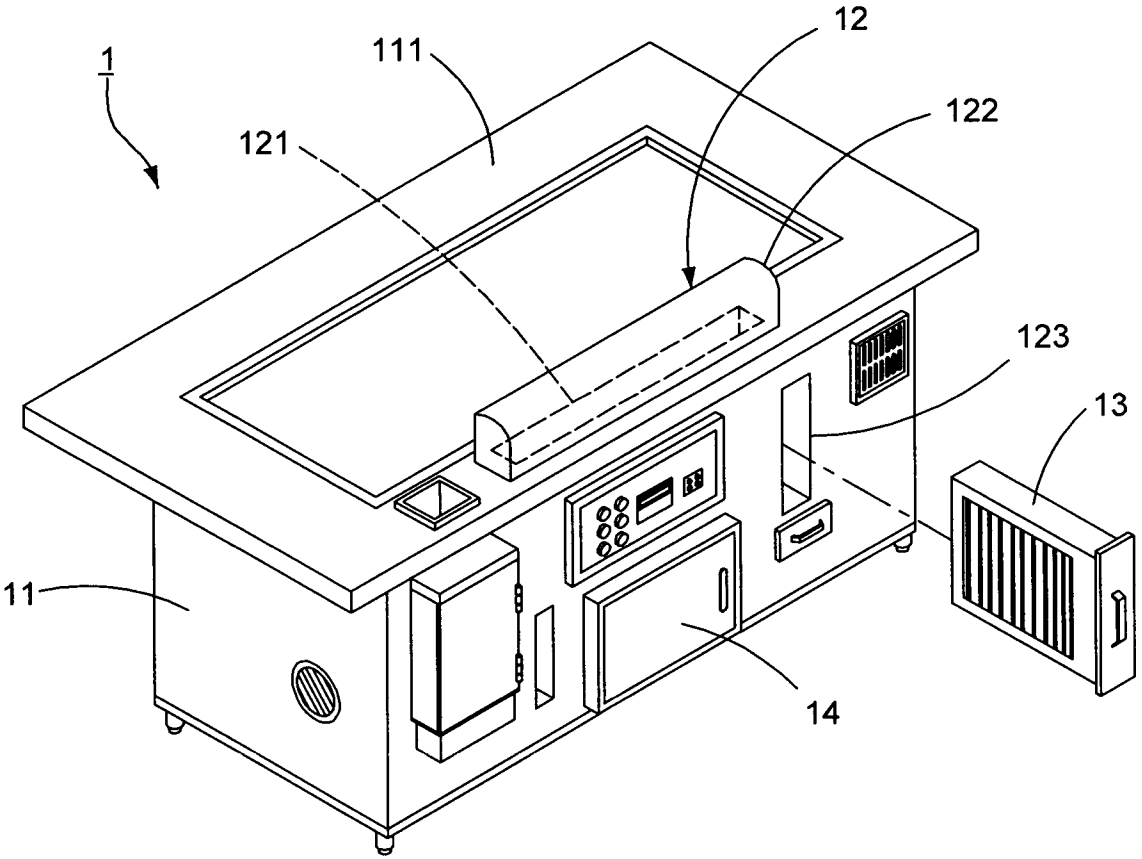
FIG.1(PRIOR ART)
FIG. 1 is a schematic view showing a conventional teppanyaki assembly.
Figure 2:
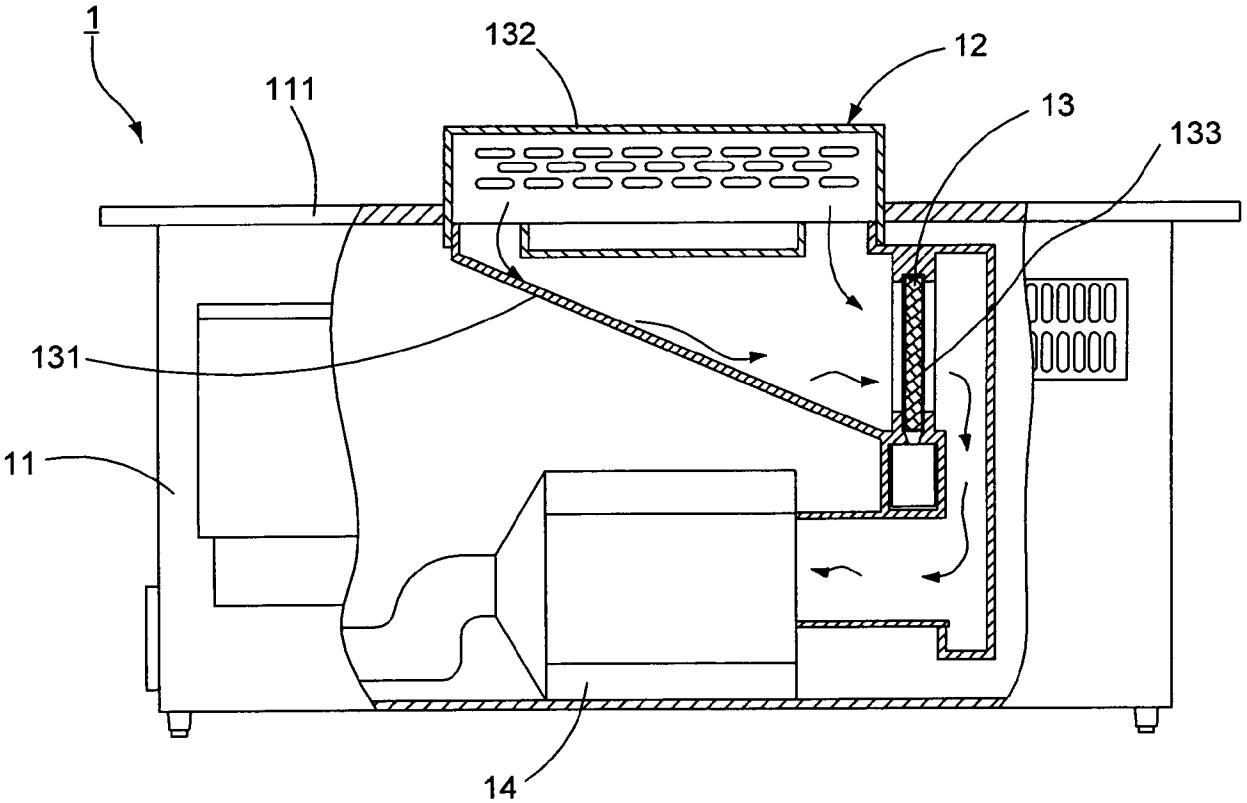
FIG.2(PRIOR ART)
FIG. 2 is a cross-sectional view showing an interior of FIG. 1.
Figure 3:
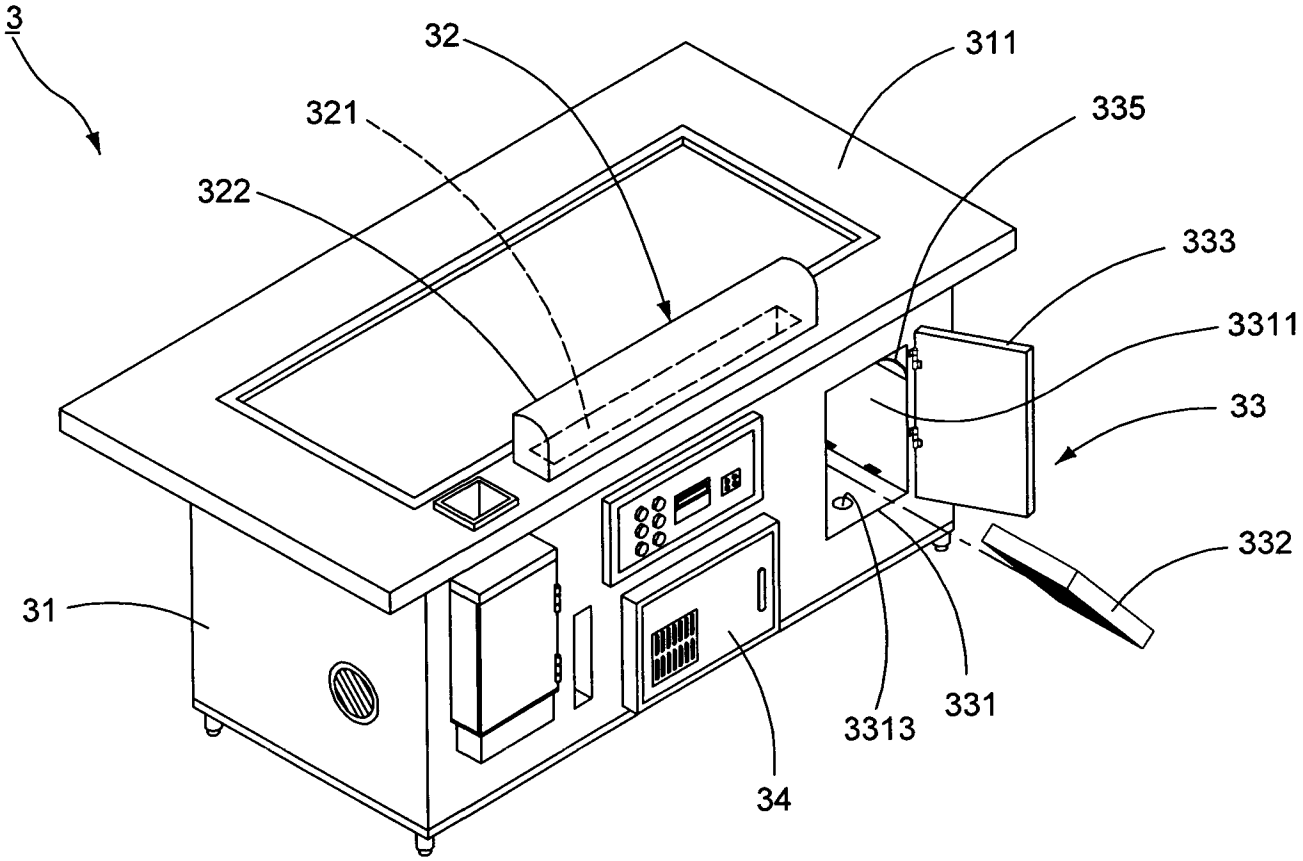
FIG. 3 is a perspective view showing a first preferred embodiment of the present invention.
Figure 4:
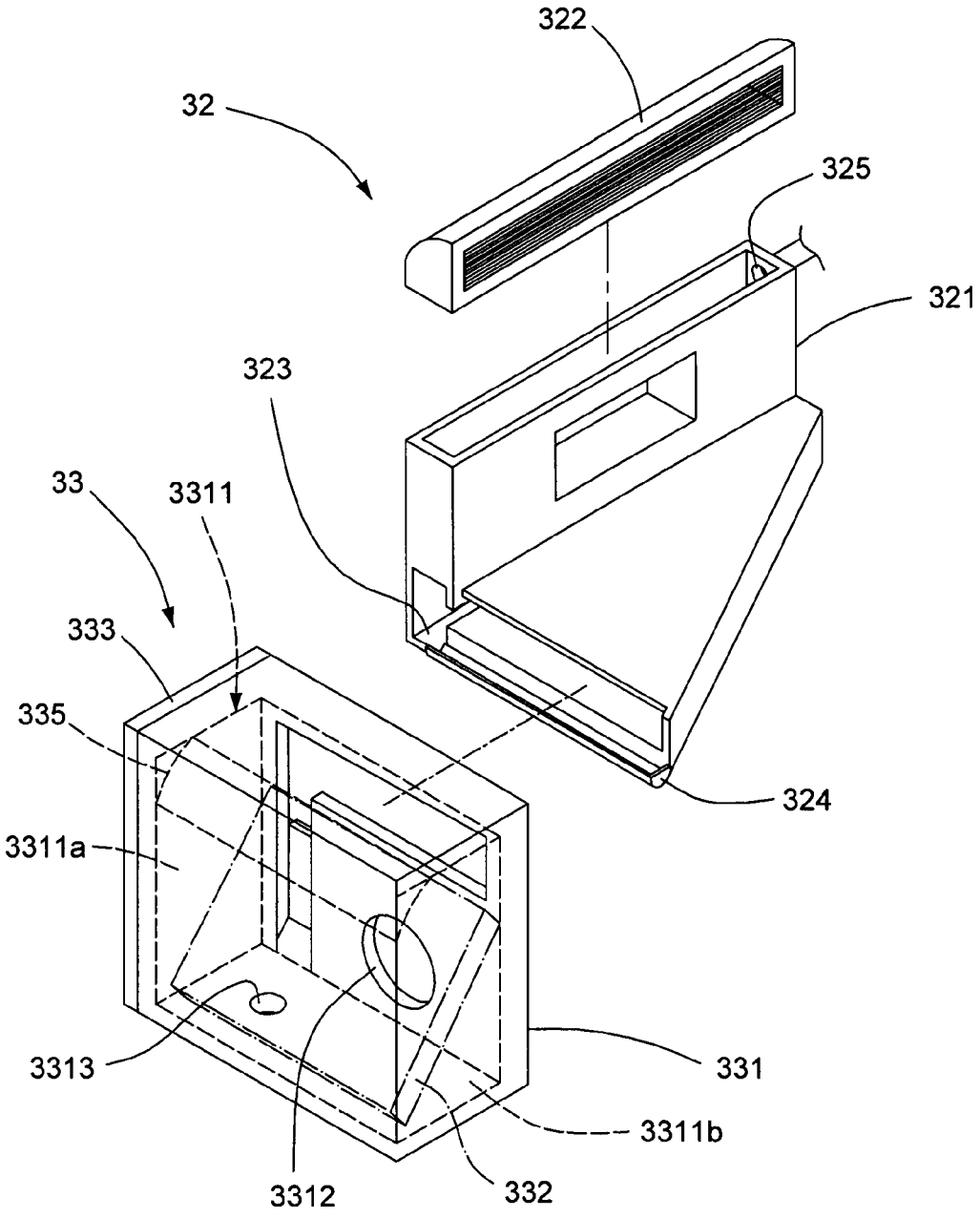
FIG. 4 is an exploded view showing the first embodiment of FIG. 3.
Figure 5:
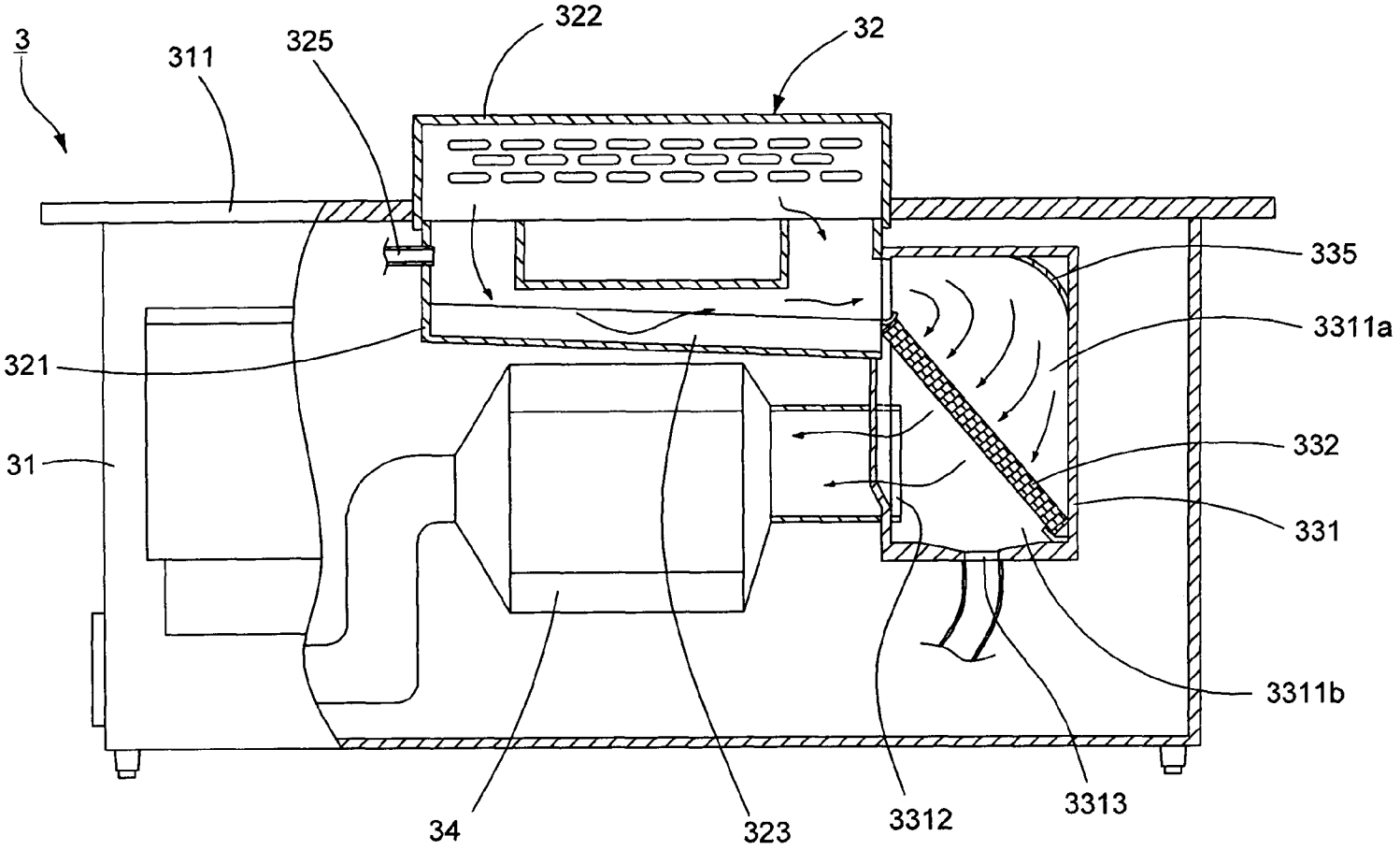
FIG. 5 is a schematic view showing the air flow within the first embodiment of the present invention while using.
Figure 6:
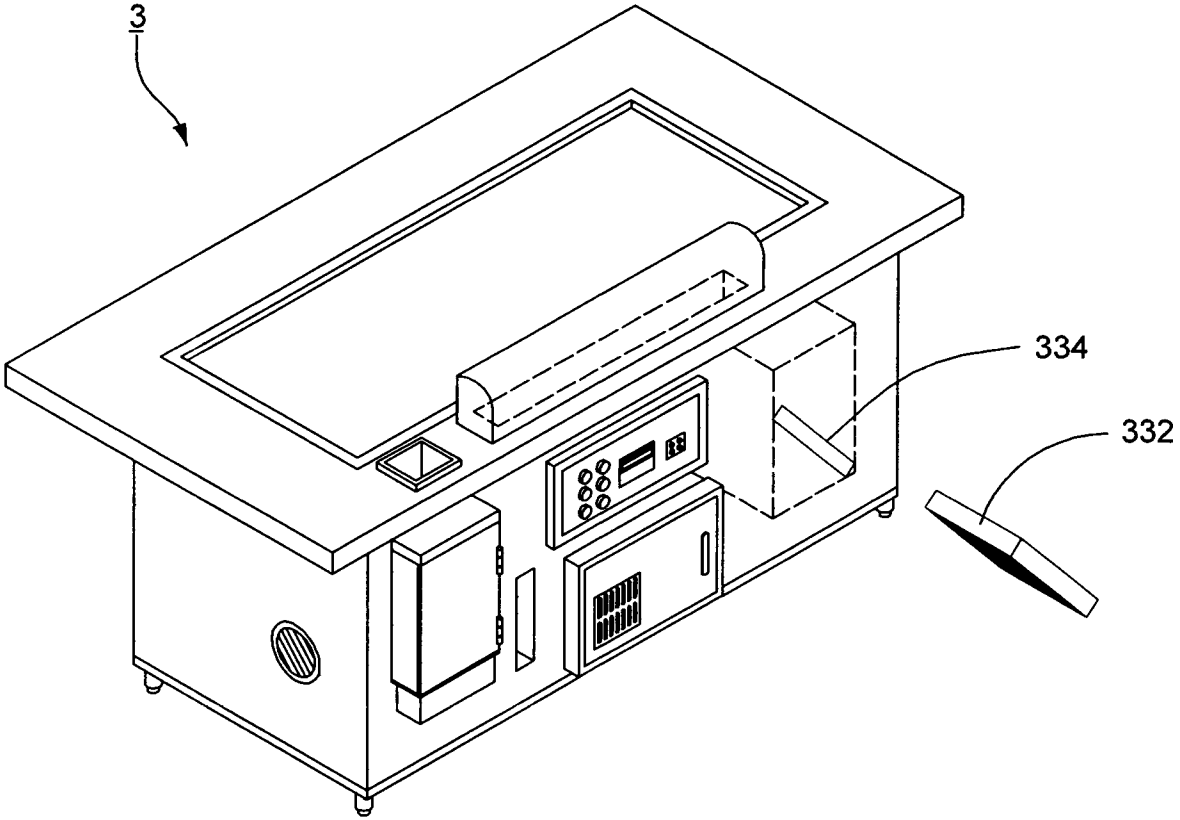
FIG. 6 is a perspective view showing a second preferred embodiment of the present invention.

Referring to FIGS. 3 to 5, a teppanyaki assembly 3 of a first preferred embodiment comprises a platform 31 having a cooking plane 311 disposed thereon, an air pump 32 disposed in the platform 31, and an air filter 33 connected to the air pump 32. Wherein, the air pump 32 has an air channel 321 defined on a side of the cooking plane 311 and a covering 322 disposed on the air channel 321. To attain the convenience of easy cleaning, on the air channel 321 forms a water inlet 325 for introducing fluid in and by the side of the air channel 321 also defines a cleaning channel 321 relative to the water inlet 323 for the fluid to traveling therealong.

Still further, the air filter 33 having a housing 331 connecting to the air channel 321 and provided with an air room 3311 defined therein and a filter screen 332 slantwise disposed within the air room 3311. On the housing 331, a wind outlet 3312 is disposed, and a water outlet 3313 is additionally formed at the bottom of the housing 331. The air room 331 is divided by the filter screen 332 into a collecting area 3311*a* and a filtered area 3311*b*, wherein the collecting area 3311*a* is communicated with the air channel 321, and the filtered area 3311*b* is communicated with the wind outlet 3312. Furthermore, to promote the air circulation within the housing 331, a guiding board 332 can be preferably disposed in the air room 3311 and arranged relative to a wall of the housing 331. Regarding to the installation of the filter screen 332 as shown in FIG. 3, a cleaning door 333 can be attached to the housing 331 so that the filter screen 332 is allowed to easily insert therein or take out by opening the door 333. Alternatively, a drawing opening 334 can be defined on the housing 331 for the filter screen 332 to be facilely taken out for rinsing or repairing. In this preferred embodiment, the addition of the cleaning door 332 is described hereto as an example. By the side of the wind outlet 3312, a filter device 34 is also disposed, so that the wind outlet 3312 is preferably communicated with the filter device 34 for removing the oil fumes from the filter screen 332. It is also noted that the preferred embodiment also includes a guiding channel 324 formed between the air channel 321 and the filter screen 332 and communicated with the cleaning channel 323, from which the fluid introduced by the water inlet 325 and the oil fumes from the cooking plane 311 are able to be efficiently discharged.

Figure 7:
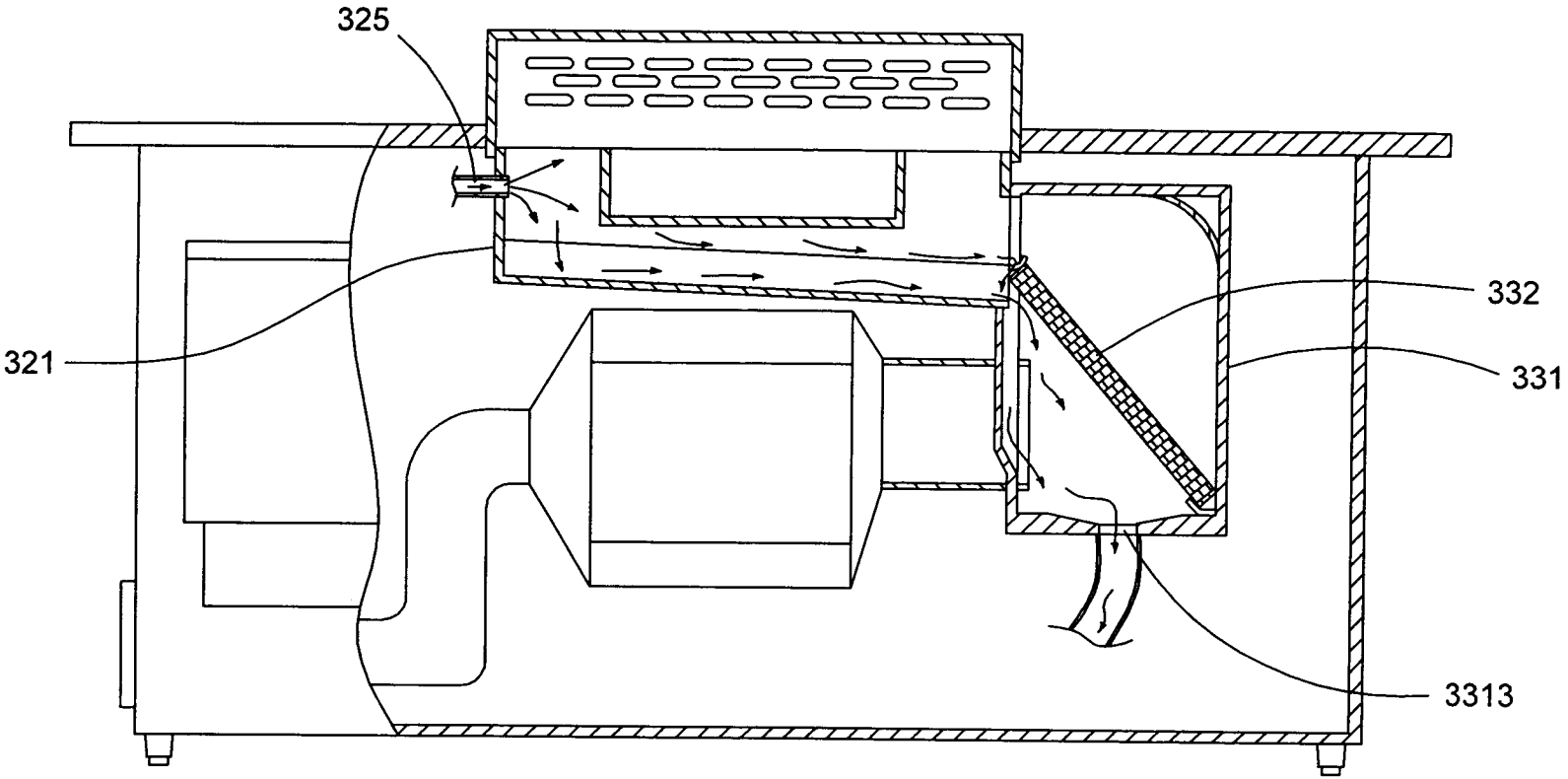
FIG. 7 is a schematic view showing the water flush for a direct cleaning of the present invention.

Referring to FIGS. 3 to 5, when the teppanyaki assembly 3 starts pumping or extracting, oil fumes and smelly air produced by the cooking plane 311 are drawn as arrowed to sequentially pass through the covering 322, the air channel 321 and enter the collecting area 3311*a*, where the oil fumes are able to temporarily stay. Thereafter, the oil fumes passes through the filter screen 332 for being initially filtered and thence arrives the filtered area 3311*b* to become a filtered air. The filtered air is hence discharged from the wind outlet 3312 and sent to the filter device 34 for accomplishing the complete filtration. According to the arrangement of the filter screen 332 inclinedly disposed in the housing 331, the filtering area thereof is increased to expand the area available for capturing or intercepting the oil fumes as well as to increase the quantity of transient air flow. Accompanying with the design of the collecting area 3311*a*, the traveling of oil fumes through the filter screen 332 can be temporarily delayed so as to efficiently reduce the wind resistance caused by the filter screen 332 for benefiting to an increase of the wind flow by promoting the flow from 30-35% to above 70%. Thereby, the problem of air pollution and the extra consumption of energy can be prevented. Also referring to FIG. 7, when the user wants to clean the air channel 321 and the housing 331, the fluid as arrowed is directly introduced from the water inlet 325 into the air channel 321, so as to flush the oil grime stunk on the surface of the air channel 321, and then the fluid flows along the cleaning channel 321 and directly goes into the filtered area 3311*b* without passing through the filter screen 332. Thence, the fluid is discharged from the water outlet 3313 after flushing, so that the cleaning process is finished. To attain a detailed cleaning, the user can also open the cleaning door 333 to directly take the filter screen 332 out and easily subject the air channel 321 and the housing 331 to a series of deep washing and inspecting processes such as repairing and maintaining, which increases a using convenience.

To sum up, the present teppanyaki assembly capable of removing the oil grime takes advantage of the air filter comprising the housing and the filter screen in a slantwise disposition, so as to increase the area of the filter screen available of catching the oil fumes and allowing the increased transient air flow to pass therethrough. The oil fumes is efficiently delayed while passing the filter screen, which facilitates to a decreased wind resistance from the filter screen and an increased wind flow for promoting an effect of extracting and intercepting the oil fumes. Further, the present invention can directly flush the air channel and the housing or execute the removal of oil grime from the housing via the cleaning door, thereby benefiting to cleaning and inspecting efficiency and the using convenience.

While we have shown the embodiment for the present invention, it should be clear to those skilled in the art that further embodiments may be made without departing from the scope of the present invention.

What is claimed is:

1. A teppanyaki assembly comprising:

a platform having a cooking plane disposed thereon;

an air pump having an air channel defined on a side of said cooking plane and a covering disposed on said air channel;

an air filter vertically off-set and below the air channel, said air filter having a housing defining an air room and a wind outlet disposed on said housing, said air room including a filter screen angularly disposed therein, said filter screen thereby dividing said air room into a first chamber defining a collecting area and a second chamber defining a filtered area, said collecting area being in lateral communication with said air channel for permitting air to be inserted into said collecting area, and said filtered area being in lateral communication with said wind outlet, whereby air from said air pump flows into said collecting area and accumulates in said collecting area prior to passing through said filter screen;

a filter device for re-filtering communicates with said wind outlet; and a cleaning channel is disposed by the side of said air channel for fluid to flow and is communicated with said filtered area in said air room, and an outlet is disposed on said housing for discharging said fluid therefrom.

2. The teppanyaki assembly as claimed in claim 1, wherein a guiding channel is formed between said air channel and said filter screen and is communicated with said cleaning channel.

3. The teppanyaki assembly as claimed in claim 1, wherein a water inlet is formed on said air channel for an entrance of said fluid.

4. The teppanyaki assembly as claimed in claim 1, wherein a cleaning door is disposed on said housing.

5. The teppanyaki assembly as claimed in claim 1, wherein a drawing opening is disposed on said housing for taking said filter screen out.

6. The teppanyaki assembly as claimed in claim 1, wherein a guiding board is disposed in said air room relative to a wall of said housing.

* * * * *